US005098070A

United States Patent [19]

Takahashi

[11] Patent Number: 5,098,070

[45] Date of Patent: Mar. 24, 1992

[54] FURNACE ATMOSPHERE REFORMING CATALYSTIC AGITATOR

[75] Inventor: Susumu Takahashi, Yokohama, Japan

[73] Assignee: Kanto Yakin Kogyo K.K., Japan

[21] Appl. No.: 546,926

[22] Filed: Jul. 2, 1990

[30] Foreign Application Priority Data

Jul. 10, 1989 [JP] Japan ..... 1-80875

[51] Int. Cl.[5] ..... C21D 1/06

[52] U.S. Cl. ..... 266/157

[58] Field of Search ..... 266/257

[56] References Cited

U.S. PATENT DOCUMENTS 4,294,436 10/1981 Takahashi ..... 266/257

FOREIGN PATENT DOCUMENTS 1049888 2/1959 Fed. Rep. of Germany ..... 266/257

162941 9/1984 Japan ..... 266/257

*Primary Examiner*—Melvyn J. Andrews

*Attorney, Agent, or Firm*—Shlesinger, Fitzsimmons & Shlesinger

[57] ABSTRACT

A gas agitator for reforming a furnace atmosphere in a continuous heat treatment furnace. Rotary vanes of the agitator induces the furnace atmosphere toward the center of rotation of the vanes, due to a negative pressure produced by the rotation of vanes. Additive gas for reforming the atmosphere in the furnace is also introduced to said center. The atmosphere and additive gases are mixed with each other at once when the additive gas is introduced into the furnace, and radially ejected to contact with an annular catalyst agent. The annular inner surface of catalyst agent is located closely to rotary locus of the vanes, so that the mixed atmosphere and additive gases can come into immediate contact with the catalyst. The catalyst agent has no bottom, so that the furnace atmosphere is freely induced to the center of rotation of vanes, on account of the aforementioned negative pressure generated at and about said center.

1 Claim, 1 Drawing Sheet

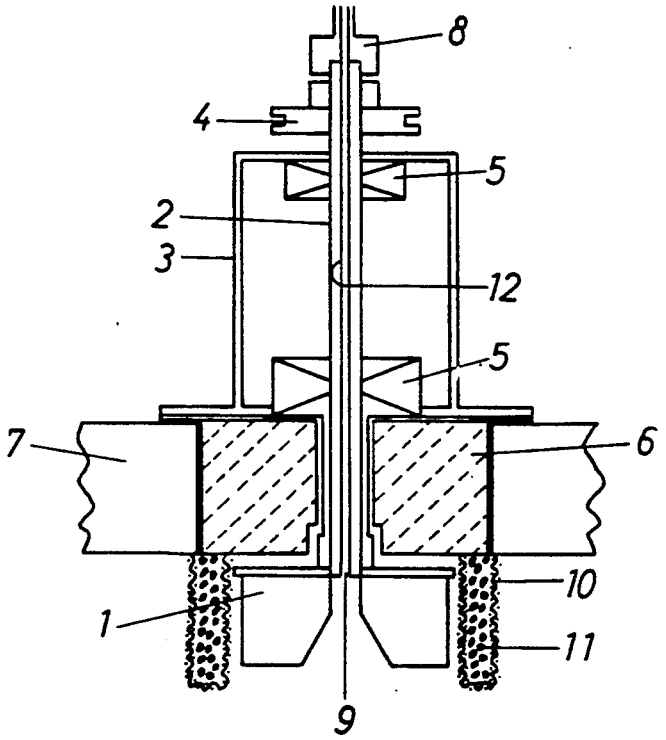
8
4
5
2
3
12
5
7
6
10
1
11
9

FURNACE ATMOSPHERE REFORMING CATALYSTIC AGITATOR

BACKGROUND OF THE INVENTION

This invention relates to a continuous atmosphere furnace which is employed for the heat treatment of metallic articles in a specific atmosphere. And, more particularly, it relates to agitator means utilized in such continuous atmosphere furnace for promoting the reformation of its specific atmosphere.

Heretofore, the formation or reformation of a furnace atmosphere to a desired composition has been made generally by mixing an additive gas into the furnace atmosphere.

In this instance, the additive gas introduced into the furnace can act to reform the existing furnace atmosphere by its reaction with the furnace atmosphere only when the additive gas is heated and mixed well with the furnace atmosphere. Therefore, if the additive gas is not properly introduced into the furnace, that is, without due consideration of its relation with articles to be treated in the furnace, the atmosphere will come into contact with the articles before it has been reformed substantially completely. Poor reformation of the furnace atmosphere will often result in poor or inadequate heat-treatment of articles in the furnace.

In this context, reference is made to U.S. Pat. No. 4,292,436 of this inventor. In the furnace for the heat-treatment of metallic articles with a protective atmosphere which is disclosed in said U.S. Patent, a substantial part of raw gases supplied into the furnace will disadvantageously make contact with metallic articles to be heat-treated before they make contact with catalytic and heating means and are reformed into a disired composition, although fans intend to agitate the raw gases radially before they make contact with the metallic articles.

Reference is further made to Japanese Preliminary Patent Publication No. 54-64633 which discloses a carburizing furnace, into which the constituents for producing the desired atmosphere are supplied dropwise. In this furnace, a gas agitator is rotated within a space, lateral sides of which are encircled by wire gauzes containing a catalyst, and bottom side of which is closed by an upper plate of a muffle. Although this muffle prevents the incoming constituents to drop directly over articles to be heat-treated, it also prevents the existing furnace atmosphere from passing upwardly into the space where the gas agitator is rotated. This means that it can hardly be expected that the incoming atmosphere constituents falling dropwise into the space will be mixed there with the furnace atmosphere and reacted by the gas agitator. In other words, this gas agitator acts primarily as an atomizer which is vigorously rotated so as to atomize the incoming atmosphere constituents and radially and forcibly disperse them as soon as they are dropped into the agitator space. It acts therefore little as an agitator.

It is further disadvantageous in this type of carburizing furnace that since a dropper pipe is to be provided and opened between the circular catalyst and the agitator and adjacently to a rotary path of vanes of the gas agitator so that the incoming constituents falling down from the dropper shall be atomized in an instant by wind current of the agitator, it is impossible to locate the circular catalyst very closely to the agitator on account of the above-mentioned interposition of the liquid dropper between them.

BRIEF DESCRIPTION OF THE DRAWING

The single FIGURE in the drawing is a fragmentary sectional view taken through the upper wall of an elongate, continuous atmosphere furnace on a plane extending transverse to the length of the furnace, and illustrating a furnace atmosphere reforming agitator made according to one embodiment of this invention.

BRIEF SUMMARY OF THE INVENTION AND DETAILED DESCRIPTION OF THE DRAWING

In the accompanying single drawing which is an explanatory cross sectional view of furnace atmosphere reforming agitator means made in accordance with this invention, numeral 7 denotes fragmentarily the upper wall of a continuous atmosphere furnace. Secured at its lower end over an insulator 6, which is mounted in an opening in the housing wall 7, is a frame or housing 3. Rotatably mounted intermediate its ends in a pair of axially spaced bearings 5, which are secured in housing 3 adjacent the upper and lower ends thereof, respectively, is an elongate, tubular shaft 2. Shaft 2 projects out of the upper end of housing 3, as shown in the drawing, through the center of a circular pulley 4, which is secured to shaft 2 above the upper end of housing 3, and into the lower end of a rotary joint 8, which is positioned above the pulley 4. It will be apparent that pulley 4 is disposed to be connected to a drive means which can be used to impart rotation to the pulley 4, and hence the shaft 2 about a vertical axis. Shaft 2 projects at its lower end out of an opening in the bottom of housing 3, and coaxially through a central opening in the insulator 6 and has fastened to the lower end thereof a plurality of radially projecting vanes 1, which are disposed to be rotated by shaft 2 adjacent the under surface of the upper furnace wall 7, and coaxially within an annular, mesh cage 10, which is secured at its upper end underside of the insulator 6 and furnace wall 7 coaxially of the axis of rotation of shaft 2. The mesh cage 10 contains a catalyst 11, the purpose of which will be noted in greater detail hereinafter.

In use, a tube 12, which is secured coaxially in the bore of the shaft 2, is adapted to be connected at its upper end to a supply of gas which is disposed to be inserted into the atmosphere existing in the furnace interior, which, of course, is positioned beneath the upper wall 7 of the furnace. Gas entering the tube 12 from the supply thereof is discharged, as noted hereinafter, out of the gas outlet 9 at the lower end of tube 12, and centrally of the radially extending plates 1 on shaft 2. The vanes 1 are designed such that, as the shaft 2 is rotated, the vanes generate at their inner ends adjacent the outlet 9 a vacuum, which causes gases to be drawn or sucked toward the center of the vanes, and then to be forced radially outwardly by the vanes and through the surrounding mesh cage 10.

In this invention, it has thus been devised to have almost all of the thus sucked furnace atmosphere gases to be formed into contact forcedly with a catalyst 11 retained within a mesh cage 10. In order to achieve this, said mesh cage has a bottom-opened annular shape, an inner annular surface which is extremely closely located to a rotary path followed by the outer ends of the vanes 1, and an axis which is coaxial with the rotary shaft 2.

The agitator means of this invention has characteristic features as follows.

When an additive gas is supplied from the direction of a rotary joint 8 into the furnace through the supply tube 12, said additive gas is sucked to the gas outlet 9 and directed toward the center of rotary movement of the vanes 1, because a negative pressure is exerted at and about the gas outlet 9. At this time, the existing furnace atmosphere is also draws toward the gas outlet 9 or the center of rotary radius of the vanes 1, whereby the additive gas and the furnace atmosphere are mixed well by the rotation of vanes at once when the additive gas is introduced into the furnace, and before it contacts with any other substance.

The mixing of gases resulting from the suction of them due to a negative pressure described above is very effective for thoroughly mixing them. It is also advantageously noticed that if an amount of additive gas is small, as compared to an amount of the furnace atmosphere sucked to the center of the rotation of vanes 1, the mixing thereof shall scarcely suffer from lowering of temperature, and their reaction speed will consequently be quick.

The furnace atmosphere and the additive gas thus mixed together pass through a catalyst 11, whereby their reaction is accelerated to produce a gas atmosphere of a desired composition. This gas circulates then within the furnace to perform a predetermined heat treatment.

EXAMPLE

An embodiment of this invention is explained further in concrete hereunder with reference to the accompanying single drawing.

The drawing shows an agitator made in accordance with this invention, which is employed in reforming a furnace 10 atmosphere in a gas carburizing furnace. The vanes 1 are made of heat-resistant steel, meshed gauges 10 are made of inconel wires, and catalysts 11 work at a comparatively low temperature such as 900°-940° C. which corresponds to a carburizing temperature.

The outer diameter of rotation of the vanes 1 is about 400 mm, their heights are about 200 mm, and rotary velocity was 1,200 rpm. The gas transmission of the catalysts 11 contained in the wire meshes 10 was about 50%.

As a furnace atmosphere for carburizing an endothermic 20 gas (consisted of CO, $H_2$, $CO_2$, $H_2O$, $CH_4$, $N_2$) made by the conversion of butane gas was employed, while the additive gas was a city gas, principal constituent of which is methane. Amounts of CO and $CO_2$ of the furnace atmosphere were measured by infrared analysis to determine a carbon concentration thereof, while the temperature thereof was also measured. The control of the additive gas was made automatically by the operation of said concentration and temperature. More specifically the amount of furnace atmospher was 10 $m^3/h$, additive gas was 0–0.04 $m^3/h$, temperature was 910° C., and carbon concentration was able to be maintained constantly at 7.9%.

In the continuous furnace in which the agitators of this invention is employed, its atmosphere gas passes through different temperature zones from the time when the gas is introduced into the furnace till it is exhausted from the furnace. Accordingly, it is necessary that irrespectively of difference of temperatures at each zones, gas constituents of the furnace atmosphere, viz. carbon concentration in this Example are to be reformed and kept precisely in the concentrations necessary to effect the purpose of heat treatment.

As numerically shown above, because of the employment of agitators made in accordance with this invention, the furnace atmosphere was effectively and quickly reformed by the additive gas, whereby carburizing operation was made stable.

I claim:

1. In combination with a continuous atmosphere heating furnace enclosure having an interior and an exterior, and having an upper wall, said upper wall having an inside surface facing the interior of said enclosure and an outside surface facing exteriorly of said enclosure, an improved gas agitator comprising, a shaft having opposite ends and being rotatably mounted intermediate said opposite ends thereof in said upper wall of said furnace enclosure, and having therethrough an axial bore having an inlet end communicating at said exterior of said furnace enclosure with a supply of additive gas, and having an outlet end opening on said interior of said furnace enclosure adjacent said inside surface of said upper wall of the furnace, a plurality of angularly spaced vanes having inner ends and outer ends, and being secured at their inner ends to and projecting radially from said shaft beneath said upper wall and adjacent to said outlet end of said bore in said shaft, said vanes being operative upon rotation of said shaft to produce negative pressure adjacent said inner ends of said vanes and said outlet end of said axial bore in said shaft, whereby upon rotation thereof said vanes are operative to draw atmosphere gases from within the furnace toward the axis of rotation of said shaft, and simultaneously to draw additive gas from said supply thereof, and to force said atmosphere gases and said additive gas radially outwardly at right angles to the axis of rotation of said shaft, and an annular cage surrounding said vanes coaxially of said axis of rotation of said shaft, and having an inner peripheral surface disposed in radially spaced confronting relation to said outer ends of said vanes, said cage containing catalysts which are disposed to be contacted by said atmosphere and additive gases as said gases are forced radially outwardly by the rotation of said vanes.

* * * * *